US011507021B2

(12) United States Patent
Javet et al.

(10) Patent No.: US 11,507,021 B2
(45) Date of Patent: Nov. 22, 2022

(54) METHOD FOR PRODUCING FRICTION BY INDENTING

(71) Applicant: ROLEX SA, Geneva (CH)

(72) Inventors: Jérôme Javet, Geneva (CH); Christian Prenez, Nidau (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 17/589,290

(22) Filed: Jan. 31, 2022

(65) Prior Publication Data

US 2022/0155726 A1 May 19, 2022

Related U.S. Application Data

(63) Continuation of application No. 16/552,141, filed on Aug. 27, 2019, now Pat. No. 11,256,216.

(30) Foreign Application Priority Data

Sep. 3, 2018 (EP) ..... 18192226

(51) Int. Cl.
*G04B 11/00* (2006.01)
*G04B 13/02* (2006.01)

(52) U.S. Cl.
CPC ..... *G04B 11/003* (2013.01); *G04B 13/026* (2013.01); *G04B 13/021* (2013.01)

(58) Field of Classification Search
CPC .. G04B 11/003; G04B 13/021; G04B 13/022; G04B 13/026
See application file for complete search history.

(56) References Cited

U.S. PATENT DOCUMENTS 3,930,361 A * 1/1976 Saito ..... G04B 13/023 368/323
2015/0160615 A1* 6/2015 Beugin ..... G04B 15/06 368/323
2019/0041799 A1* 2/2019 Gaugey ..... B32B 15/01
2020/0073328 A1* 3/2020 Javet ..... G04B 13/026

FOREIGN PATENT DOCUMENTS

CH 41140 A 9/1908
CH 104836 A 5/1924
CH 129931 A 1/1929
CH 685462 A3 * 7/1995 ..... G04B 11/003
CH 685 462 B5 1/1996
(Continued)

OTHER PUBLICATIONS

UNIMECSA;IndentingMachine; YoutubevideoandwebsitePDFdocument;https:/Avwww.youtube.com/watch?v=mhxxQJ_dvf0; httos:/Avww.unimecsa.ch/products_en/assembly_and_machining_equipment_en/indenting_machine_en; pp. 1-2 (Year: 2014).*
(Continued)

*Primary Examiner* — Bayan Salone
(74) *Attorney, Agent, or Firm* — WHDA, LLP

(57) ABSTRACT

A method for producing a tube for a friction system comprising the tube and an arbor, in particular a tube provided to rub around a pinion arbor, the method comprising a first stage of plastic deformation of the tube, in particular a first stage of plastic deformation of the tube that is controlled in deformation, followed by a second stage of hardening of the tube, in particular hardening by heat treatment.

16 Claims, 1 Drawing Sheet

(56) References Cited

FOREIGN PATENT DOCUMENTS

| | | | | |
|---|---|---|---|---|
| EP | 2 881 803 | A1 | 6/2015 | |
| EP | 2881804 | A2 * | 6/2015 | ..... G04B 13/02 |

OTHER PUBLICATIONS

European Search Report and Written Opinion dated Feb. 19, 2019 issued in counterpart application No. EP18192226; w/ English machine translation (18 pages).
UNIMECSA SA, "Pavement lantern", May 27, 2014, 10 pages; w/ English machine translation; cited in the European Search Report.

* cited by examiner

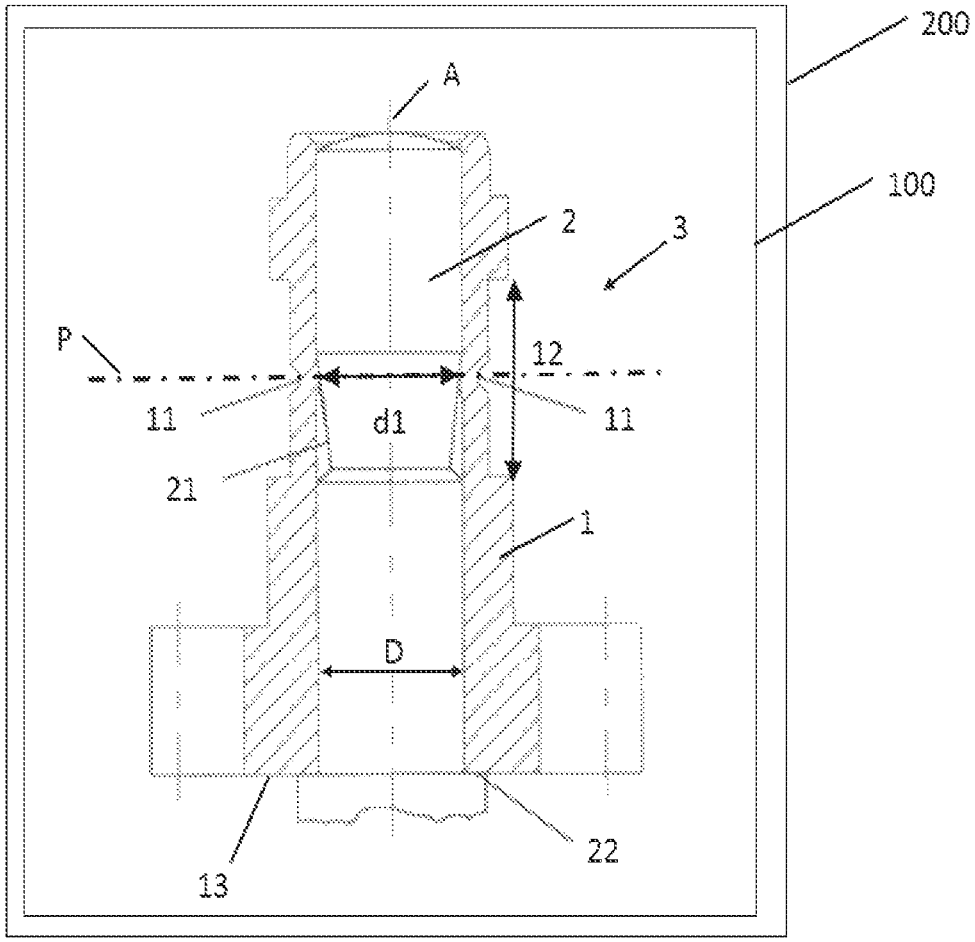
200
A
100
2
3
P
12
11
d1
11
21
1
D
22
13

METHOD FOR PRODUCING FRICTION BY INDENTING

This application is a continuation of U.S. application Ser. No. 16/552,141, filed on Aug. 27, 2019, which claims priority to European patent application No. EP18192226.1 filed Sep. 3, 2018, the contents of which prior U.S. and European applications are both hereby incorporated by reference herein in their entireties.

The invention relates to a method for producing a tube for a friction system. It also relates to a method for producing friction between an arbor and a suchlike tube. It further relates to a tube for producing a suchlike friction. It further relates to an assembly producing a suchlike friction. It further relates to a movement comprising a suchlike tube or a suchlike assembly. It finally relates to a timepiece, in particular a wristwatch, comprising a suchlike tube or a suchlike assembly or a suchlike movement.

Driving of the hands or the discs for the display of the time on a watch generally takes place by means of a cannon pinion, which is pinched and is then driven onto a pivot shank of a center pinion. Pinching creates two bulges into the tube or on the internal diameter of the cannon pinion, which bulges come into contact with the pivot shank and in so doing ensure the transmission of the rotation of the center pinion to the cannon pinion, by friction of the bulges on the pivot shank, in the normal mode of operation for displaying the time.

The adjustment of the diameter of the pivot shank and the distance between bulges ensures the transmission of a torque facilitating the rotation of the minute hand. The higher this torque, the better the hands will perform under shocks. In time-setting mode, the rotation of the stem causes rotation of the cannon pinion by means of a correction mechanism, which slides on the center pinion in order to position the hand in the right place relative to the dial.

A suchlike cannon pinion/center pinion structure, for example, constitutes an indenting.

The consequence of a rubbing torque or a friction torque that is too high is an impression of difficult setting, and it also induces wear in the indenting.

It is necessary, therefore, for the torque transmitted by the cannon pinion to be sufficiently high to prevent untimely sliding of the hands, although it should not be too high, so as to obtain a qualitative impression when setting the time.

For reasons linked to the materials and to the dimensions of the parts, it is difficult to obtain high friction torques for an internal diameter of a cannon pinion in the order of 0.3 to 1 mm with cannon pinions manufactured in a traditional manner. This torque is sufficient for conventional hands, although the use of hands in precious metals or hands of large size requires a higher tightening torque in order to guarantee their retention, in particular when subjected to shocks.

If an attempt is made to make larger bulges in order to increase the torque, the material will crack and the results will be irregular. It is not possible, therefore, to guarantee the resistance, in particular the resistance to shocks, of hands with high inertia without causing the cannon pinion to crack at the time of the indenting operation.

Traditionally, the indenting operation is performed by pinching for the purpose of shrinking a tube of the cannon pinion with respect to a step or a recess of the pivot shank. This pinching is a manual task, and its result will depend of the dexterity and the sensitivity of the watchmaker, and it is random for this reason. This is inconvenient because, as noted previously, the aim of indenting is to assure a certain level of friction between the pivot shank and the cannon pinion in the course of the normal operation of the watch with the intention of causing the time to be displayed, whereas the manual operations of setting the time by the wearer apply a torque greater than that of the friction. The friction torque must not be too high, therefore.

The correct adjustment of the friction torque is difficult, therefore. The cannon pinion is a fragile component, furthermore, and the reworking of an indenting after dismantling often results in deterioration requiring the replacement of the cannon pinion.

Accurate monitoring of the applied tightening force is important, therefore, and traditional manual indenting does not allow to achieve this accuracy, or the required reproducibility.

In document CH129931, the cannon pinion is adjusted with friction fit on the arbor of the minute pinion, which generally comprises a groove ("indenting notch") for housing two bulges generated in the wall of the cannon pinion. A sufficient quality of a suchlike assembly may be assured only by matching the cannon pinion and the center pinion in a manner such that the indenting is perfectly adjusted, at the risk of seeing the cannon pinion falter and the hands move at an inopportune moment. Document CH129931 proposes a solution that has become traditional, involving the use of a pinion with a supporting cone ensuring centering of the cannon pinion on the center pinion before indenting.

The indenting of the cannon pinion is accordingly a traditional method which calls for dexterity on the part of the watchmaker, who must sometimes rework the cannon pinion in order to adapt it to the pinion, or must have a thorough understanding of the geometries or the torques obtained in the case of more industrial productions.

The functional tolerances are small, as are the nominal dimensions of the components. Any modification of a dimension potentially involves a malfunction of the system, and, in industrial productions, it is necessary to proceed to the matching of batches of cannon pinions and pinions which are dimensionally compatible before proceeding to assembly. This results in considerable logistical constraints.

The cannon pinion is traditionally machined from a free-cutting steel (20AP or Finemac) and is then hardened by heat treatment according to the prescriptions of the supplier in order to achieve a hardness of 550±50 HV. This hardness corresponds to a compromise in order to permit both the deformation of the cannon pinion without cracking during the indenting stage and the maintenance of the torque over time. The material is brought into a metallurgical state permitting the indenting to be corrected by the watchmaker until the correct torque is obtained.

A consequence of this hardening heat treatment, in addition to increasing the hardness of the cannon pinion in order to make it more resistant to wear, is to increase the springback and to reduce the elongation at break. On the other hand, it modifies the dimensions of the cannon pinion only to a negligible extent, even on the horological scale.

In view of the industrial manufacturing tolerances of the cannon pinions and the center pinions, batches of cannon pinions must be matched with batches of center pinions in a manner such as to assure their dimensional correspondence.

The indenting stage generates a contraction of the internal diameter of the cannon pinion on an axis situated in the plane perpendicular to the axis of the cannon pinion in order to bring the distance between bulges to a chosen theoretical value.

The parts are subsequently assembled on the movement: the cannon pinion is driven onto the center pinion, and the two bulges produced in the course of the preceding stage are slightly spread apart elastically during insertion onto the pinion and are then housed in a groove or on a cone produced on the pinion and assure the positioning relative to the two parts on the axis of the cannon pinion, as well as the relative retention of the two parts in rotation until a friction torque defined by the geometry and the rigidity of the parts is achieved.

This torque is controlled or measured and, if it is not sufficient, the cannon pinion is removed and replaced or is pinched once more.

The characterizing features of the material of the two components are a hardness of respectively 550±50 HV for the cannon pinion and 650±50 HV for the pinion, both made of 20AP steel.

Document EP2881803 describes a recent alternative to indenting achieved with the help of a ring made of a shape memory alloy intended to tighten the cannon pinion about the pivot shank. The ring is enlarged at a low temperature (martensitic state), is positioned facing the zone of the cannon pinion and is then heated in order to obtain the austenitic structure permitting its constriction and the controlled retention of the cannon pinion on the pivot shank.

Document CH41140 proposes a cannon pinion having a longitudinally split canon facilitating the insertion of the cannon pinion onto the center pinion. A circular edge created on the lower part of the cannon pinion is inserted onto a groove situated between steps of the center pinion.

Several problems are associated with the known solutions of the prior art. First, the typical torque values measured on cannon pinions obtained in a traditional manner are limited, and a high torque could be obtained only by dimensional changes, which are not always possible because of the respective dimensions of the components and because of the mechanical properties of the material.

Then, control of the indenting torque is not capable of being industrialized with the known methods without matching, because the torque depends very accurately on the internal diameter of the cannon pinion and the external diameter of the center pinion. The tolerances of machining and of the supplementary dispersion induced by the heat treatment and then the pinching are such that it is necessary to match batches in order to guarantee a friction torque within the stipulated tolerances. Even with suchlike matching, the standard deviation of the torques measured on sets of at least 500 tubes assembled on 500 arbors is in the order of 0.3 to 0.35 mNm.

The object of the invention is to make a friction device available by indenting in order to address the aforementioned disadvantages, and to improve the devices that are known from the prior art. In particular, the invention proposes a simple, reliable and reproductible friction device and a method for producing a suchlike device.

A method according to the invention is defined by point 1 below.

1. A method for producing a tube for a friction system comprising the tube and an arbor, in particular a tube provided to rub around a pinion arbor, the method comprising a first stage of plastic deformation of the tube, in particular a first stage of plastic deformation of the tube that is controlled in deformation, followed by a second stage of hardening of the tube, in particular hardening by heat treatment.

Different modes of implementation of the method are defined by points 2 to 7 below.

2. The method for producing a tube for a friction system comprising the tube and an arbor, in particular a tube provided to rub around a pinion arbor, the method comprising a stage of plastic deformation of the tube, controlled in deformation, the deformation stage being performed on a portion of the tube in the annealed condition and/or of which the elastic limit is less than 1000 MPa and/or of which the hardness is less than 400 HV or less than 350 HV.
3. The method according to one of the preceding points, wherein the tube is a tube of a cannon pinion or a clutch element and/or a torque limiter element.
4. The method according to one of the preceding points, wherein the deformation stage is performed by pinching of the tube.
5. The method according to one of the preceding points, wherein the deformation stage is performed on a tube made of 20AP alloy or Finemac alloy having a hardness of less than or equal to 400 Hv, or of less than or equal to 350 Hv.
6. The method according to one of the preceding points, wherein the deformation stage is controlled by optical measurement of the deformation or by a template arranged in the tube during the deformation stage or by passing through gauges.
7. The method according to one of the preceding points, wherein the deformation is performed on a portion of the tube, of which the elongation at break is greater than or equal to 2%, or is greater than or equal to 3%.

A tube according to the invention is defined by point 8 below.

8. A tube, in particular a cannon pinion, especially an indented cannon pinion, obtained by the implementation of the method according to one of points 1 to 7.

A set of tubes according to the invention is defined by point 9 below.

9. A set of at least 500 tubes as defined in point 8, the standard deviation of the diameters of the circles centered on axes of the tubes and inscribed within the straight sections of the tubes at the level of the peaks of the bulges being less than 0.2 micrometers.

An assembly according to the invention is defined by point 10 below.

10. An assembly, in particular a center pinion-cannon pinion set, comprising an arbor and a tube as defined in point 8.

Different embodiments of the assembly are defined by points 11 and 12 below.

11. The assembly as defined in the preceding point, wherein the friction torque between the arbor and the tube is greater than or equal to 1.8 mNm, or is greater than or equal to 2.0 mNm.
12. An assembly as defined in point 10 or 11, wherein the diameter of the arbor is less than or equal to 2 mm, or is less than or equal to 1 mm.

A watch movement according to the invention is defined by point 13 below.

13. A watch movement, comprising a tube as defined in point 8 and/or an assembly according to one of points 10 to 12.

A timepiece according to the invention is defined by point 14 below.

14. A timepiece, in particular a wristwatch, comprising a movement as defined in the preceding point and/or a tube according to point 8 and/or an assembly according to one of points 10 to 12.

The FIGURE attached hereto represents by way of example an embodiment of a timepiece.

FIG. 1 is a diagram of an embodiment of a timepiece.

An embodiment of a timepiece 200 according to the invention is described below with reference to FIG. 1. The timepiece is a watch or a wristwatch, for example. The timepiece may comprise a watch movement 100, especially a mechanical watch movement, in particular automatic or electronic. The timepiece may further comprise a watch assembly, in particular a watch case intended to contain the movement.

The movement comprises an assembly 3 or a friction system 3 comprising an arbor 2 and a tube 1, in particular a tube provided to rub around a pinion arbor or a tube provided to rub around an arbor of a shafted pinion. The arbor is housed inside the tube 1. For example, the tube 1 is a cannon pinion or a cannon pinion barrel, and the arbor 2 is a center pinion, in particular a shafted center pinion.

The arbor 2 and the tube 1 each have diameters D which are equal to the finished operating clearance enabling the tube 1 to slide freely relative to the arbor 2 along an axis A and enabling the tube to rotate freely relative to the arbor 2 about the axis A. The diameters D are comprised between 0.3 mm and 2 mm, for example, or are comprised between 0.6 mm and 1 mm. Preferably, the diameters D are less than or equal to 2 mm, or less than or equal to 1 mm.

The assembly comprises an indenting, that is to say the arbor 2 and/or the tube further comprise particular conformations 11, 21 in order to produce friction between the tube and the arbor 2.

The arbor 2 comprises a groove or a conical recess 21.

The tube comprises at least one bulge 11 or at least one boss, and preferably two, three or four bulges produced in the same plane P perpendicular to the axis A or at least substantially in the same plane P perpendicular to the axis A. Preferably, the one or more bulges are produced in a portion 12 of reduced thickness of the cannon pinion.

Advantageously, the groove or the conical recess on the one hand, and the one or more bulges on the other hand, are arranged to interact by contact with one another when the arbor 2 is positioned in the tube 1, in particular when the tube is driven onto the arbor 2 until a shoulder 22 produced on the arbor 2 comes into contact with an abutment surface 13 of the tube.

In the configuration represented in FIG. 1, the one or more bulges are in contact with a portion or a circle of the groove or of the recess having a diameter d1.

Before positioning the arbor 2 in the tube 1, the distance d2 (not represented) between bulges or the diameter d2 of the circle inscribed within the straight cross section of the tube at the level of the peaks of the bulges or in the vicinity of the peaks of the bulges is less than the diameter d1.

For example, $1.01<d1/d2<1.1$, or $1.02<d1/d2<1.09$, or $1.03<d1/d2<1.08$.

Once the tube 1 has been inserted onto the arbor 2, the tube 1 is deformed elastically at the level of the bulges, in such a way that the distance between bulges or the diameter of the circle inscribed within the straight cross section of the tube at the level of the peaks of the bulges or in the vicinity of the peaks of the bulges has a value d1. It follows that the tube 1 exerts radial or substantially radial forces on the arbor 2. When combined with the rubbing between the arbor and the tube, these forces define a friction torque between the arbor and the tube. The torque depends primarily on the stiffness of the bulges and/or on the elastic deformation of the bulges and/or on the coefficient of friction at the interface between the arbor and the tube.

Preferably, the friction torque between the arbor 2 and the tube 1 is greater than or equal to 1.8 mNm, or is greater than or equal to 2.0 mNm.

As has already been seen, the tube 1 may be a tube of a cannon pinion. Preferably, a hand may be fixed to a suchlike tube. As an alternative, a hand may be cinematically connected to a suchlike tube. Thus, the assembly may be utilized for the correction of one or a plurality of hands for the indication of watch information. As an alternative, the assembly may be used to correct any type of device for the indication of watch information or information derived from the time, in particular to correct a disc. As a further alternative, the assembly may be a clutch or a torque limiter. In the case of a vertical clutch, the arbor 2 may be mobile axially relative to the tube 1 between a position such as that represented in FIG. 1 (engaged position) and a position in which the bulges are facing towards a deeper groove in the arbor 2 in which they do not rub (disengaged position, in which the tube 1 turns freely about the arbor).

Preferably, the tube 1 is made of 20AP alloy or Finemac alloy. As an alternative, the tube 1 may be made of stainless steel. As a further alternative, the tube 1 may be made of a copper-beryllium alloy such as CuBe2.

For example, the arbor 2 is made of 20AP alloy or Finemac alloy.

Modes of implementation of a method of manufacturing of the tube 1 for a friction system comprising the tube 1 and the arbor 2 are described below.

According to a first mode of implementation, the method of manufacturing the tube 1 comprises:

- a first stage of plastic deformation of the tube 1, followed by
- a second stage of hardening of the tube 1, in particular a second stage of hardening by heat treatment.

According to a second mode of implementation, the method of manufacturing the tube 1 comprises a stage of plastic deformation of the tube 1, in particular a stage of plastic deformation of the tube 1 that is controlled in deformation, the deformation stage being performed on a portion of the tube in the annealed condition, and/or of which the elastic limit is less than 1000 MPa and/or of which the hardness is less than 400 HV or less than 350 HV.

Studies have shown that the control of the pinching of the tube 1 in respect of dimension (and not in respect of force, as known from the prior art) allows a better control of the equipment and to some extent narrows the standard deviation of the final dimensions of the tube 1, in particular the distance between bulges d2 (not illustrated).

Thus, according to a third mode of implementation, the method of manufacturing the tube 1 comprises:

- a first stage of plastic deformation of the tube 1, in particular controlled in deformation, the deformation stage being performed on a portion of the tube in the annealed condition, and/or of which the elastic limit is less than 1000 MPa and/or of which the hardness is less than 400 HV or less than 350 HV, followed by
- a second stage of hardening of the tube, in particular a second stage of hardening by heat treatment.

Surprisingly, the applied heat treatment has practically no influence on the dimensions of the part, while it results in a modification of the response of the part to mechanical stresses. The response to the torque is thus more homogeneous in the case of parts that are pinched in the annealed condition or in the state of delivery than in the case of parts that have been previously hardened and then pinched.

Furthermore, the performance of the controlled pinching in respect of dimension improves the dimensional regularity of the space between the bulges. Finally, the dispersion induced by pinching of the non-hardened material is less than in the case of hardened material. As a consequence, pinching has a more homogeneous and repeatable behavior than in the case of thermally hardened material, and the dispersion of the final dimensions of the tube 1, in particular the dimension between bulges d2, associated with the method, is significantly lower.

Thus, the material worked is more ductile and is less subject to variations than material that has been thermally hardened. For example, the stage of plastic deformation is performed on the material as delivered, lightly cold-worked or in the annealed condition. This allows plastic deformations of greater amplitude, which makes it possible subsequently to obtain higher friction torques, for example above 1.6 mNm. When associated with control of the pinching in respect of dimension, and not in respect of force, this solution makes it possible further to reduce the dispersion within batches of cannon pinions and to avoid matching of the tubes 1 and the arbors 2.

In the different embodiments, the stage of plastic deformation of the tube 1 comprises the production of at least one bulge in the tube. This deformation is preferably produced by pinching.

In the different modes of implementation, and depending on the type of alloy, the stage of hardening of the tube may comprise quenching treatment followed by stress relief annealing and, if necessary, tempering treatment, or annealing treatment for structural hardening.

By proceeding according to the modes of implementation described previously, it is possible to obtain a higher friction torque for the tube/arbor assembly. In order to do this, the manufacturing range of the tubes is modified, and the bulges are produced on the tubes before the hardening heat treatment. The higher the friction torque, the more the risks of sliding of the minutes hand relative to the center pinion are prevented, in particular in the event of shock. If the hand is heavy (made of precious metals) or large in size, the risk of sliding in the event of shock is high for a given friction torque.

By proceeding according to the modes of implementation described previously, it is possible to obtain a different microstructure at the level of the bulges than by proceeding according to the ranges of the prior art, for example with carbides of a slightly larger size for the Finemac alloy but without impact on the behavior of the assembly.

Preferably, the plastic deformation of the tube 1 in order to form the bulges is performed not by controlling the force of a pinching tool pressing on the tube, but rather by controlling and/or measuring the displacement of the material in the interior of the tube 1. As an alternative, it is possible to measure and/or to control the distance present between the bulges in the course of the realization or formation thereof.

When the bulges on the tube 1 are produced on a portion of material in the annealed condition or more generally before hardening, the necessary forces are weaker, the material springback is lower and the material is more ductile, and it is thus possible to prevent cracking and to create bulges of larger dimensions, that is to say a smaller dimension d2 between the bulges.

On the other hand, according to the prior art, the operation of pinching the tube is performed on the hardened material (for example Rp0.2[20AP]>1800 MPa and Rp0.2 [Finemac]>1600 MPa after hardening heat treatment). This limits the admissible deformation to about 3%, while requiring a high force. A larger deformation in this material state causes cracking of the tube.

Thus, according to the prior art, when a machined and finished, thermally hardened cannon pinion is pinched in the traditional manner, the deformation required in order to obtain a sufficiently high torque to prevent hands of great mass from sliding may not be obtained without the risk of cracking the wall of the cannon pinion. In addition, in the light of the natural dispersion of the diameters of the cones of the center pinions, it is necessary to match the batches of indented cannon pinions and the batches of pinions in order to guarantee the torque, and likewise to revise the pinching in the course of the assembly stage. The method of manufacture according to the prior art is therefore complicated and requires measurements of the torque to be repeated as the method proceeds in order to validate the matching of the two batches in the course of assembly. It limits the tightening torque in particular if it is wished to prevent the appearance of cracks on the cannon pinions. High friction torques are accessible with the method of production that is known from the prior art only in a manual manner, by treating the assemblies one by one.

In the different modes of implementation, the deformation stage is performed, for example, by pinching the tube 1.

In the different modes of implementation, the deformation stage is performed, for example, on a portion 12 of the tube, of which the elongation at break is greater than or equal to 2%, or greater than or equal to 5%.

In the different modes of implementation, the deformation stage may be controlled by optical measurement of the deformation. As an alternative, in the different modes of implementation, the deformation stage may be controlled by a template arranged in the tube during the deformation stage or by passage through gauges. In a suchlike case, in the course of the action of the pinching tool, the tube is deformed until the bulges formed in the tube come into contact with the template. The template is selected with a diameter less than the diameter d2, such that, after the elastic withdrawal of the material at the end of the deformation action, the distance between the bulges or the diameter of the circle inscribed within the straight cross section of the tube at the level of the peaks of the bulges or in the vicinity of the peaks of the bulges has a value d2.

An embodiment of a tube according to the invention is obtained by the implementation of the method described previously.

All the tubes 1 in a batch supplied in the annealed condition may be deformed in a repeatable manner. A contrario the dispersions induced by the heat treatment in response to the plastic deformation, this heat treatment applied after plastic deformation has a weak influence on the dimensions of the tube 1, and the tolerances are narrower as a result. According to the methods described, it is thus possible to obtain a set of at least 500 tubes, of which the standard deviation of the diameters of the circles centered on the axes A and inscribed within the straight sections of the tubes at the level of the peaks of the bulges is less than 0.2 μm for a nominal value of 0.758 mm. In the case of a tube with two opposing bulges relative to the axis A, it is the standard deviation of the dimensions between peaks of the bulges that is less than 0.2 μm for a nominal value of 0.758 mm. According to the methods described, it is thus possible to obtain a set of at least 500 tubes assembled on 500 arbors, having a mean standard deviation of the measured torques of 0.20 mNm for a nominal value of 2.0 mNm.

A mode of implementation of a method for producing friction between the arbor 2 and the tube 1 comprises a phase of implementation of the method for producing a tube 1 described previously and a stage of positioning the arbor 2 in the tube 1.

According to the solution described previously, the range change in relation to the prior art has given rise to a surprising behavior of the material, in that the response to pinching is more homogeneous on a cold-worked material than on a hardened material, and in that the heat treatment of the hardening process does not influence the dimensions of the part. The range change thus makes it possible to increase the deformation of the tube and to generate, starting with equal initial dimensions, larger and more homogeneous bulges which will induce a more important final torque. This makes it possible, however, to ensure a sufficiently high torque between the tube and the arbor, so as to be able subsequently to support heavier hands. In addition, the level of reworking is significantly lower.

What is claimed is:

1. A friction system, comprising:

a tube having a plastically deformed portion formed by plastic deformation of the tube followed by hardening the tube, an arbor within said tube, and wherein a diameter of the arbor is less than or equal to 2 mm.

2. The friction system of claim 1, further including at least one of: the deformed portion of the tube has an elastic limit of less than 1000 MPa, the deformed portion of the tube has a hardness of less than 400 HV, and the deformed portion of the tube is deformed in an annealed condition.

3. The friction system of claim 1, wherein the tube is a tube of a cannon pinion or a clutch element or a torque limiter element.

4. The friction system of claim 1, wherein the deformed portion is formed by pinching the tube.

5. The friction system of claim 1, wherein the deformed portion of the tube is made with 20AP alloy or Finemac alloy having a hardness of less than or equal to 400 Hv.

6. The friction system of claim 1, wherein the deformed portion of the tube is formed in a portion of the tube having an elongation at break greater than or equal to 2%.

7. A friction system, comprising:

a tube having a plastically deformed portion formed by plastic deformation of the tube followed by hardening the tube, an arbor within said tube, and said tube being part of a set of at least 500 like tubes, wherein a standard deviation of diameters of circles centered on axes of the tubes and inscribed within straight sections of the tubes at a level of peaks of bulges is less than 0.2 micrometers.

8. The friction system of claim 1, wherein a friction torque between the arbor and the tube is greater than or equal to 1.8 mNm.

9. The friction system of claim 1, wherein said tube and arbor are part of a watch movement.

10. The friction system of claim 9, wherein said watch movement is part of a timepiece.

11. The friction system of claim 1, wherein the arbor is a pinion arbor and the tube is configured to rub around the pinion arbor.

12. The friction system of claim 2, wherein the arbor is a pinion arbor and the tube is configured to rub around the pinion arbor.

13. The friction system of claim 2, wherein the deformed portion of the tube is formed with a hardness of less than 350 HV.

14. The friction system of claim 2, wherein the tube is a tube of a cannon pinion or a clutch element or a torque limiter element.

15. A friction system, comprising:

a tube having a plastically deformed portion formed by plastic deformation of the tube followed by hardening the tube, an arbor within said tube, and the deformed portion of the tube being made with 20AP alloy or Finemac alloy having a hardness of less than or equal to 400 Hv.

16. A friction system, comprising:

a tube including a plastically deformed portion formed by plastic deformation of the tube followed by hardening the tube, an arbor within said tube, and wherein a friction torque between the arbor and the tube is greater than or equal to 1.8 mNm.

* * * * *